US012698688B1

(12) United States Patent
Mitchell

(10) Patent No.: US 12,698,688 B1
(45) Date of Patent: Aug. 4, 2026

(54) BRIDGE PLUG WITH BI-DIRECTIONAL HIGH STRENGTH HIGH EXPANSION RETRIEVABLE ANCHOR

(71) Applicant: WEATHERFORD TECHNOLOGY HOLDINGS, LLC, Houston, TX (US)

(72) Inventor: Michael W. Mitchell, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 19/186,285

(22) Filed: Apr. 22, 2025

Related U.S. Application Data

(60) Provisional application No. 63/790,493, filed on Apr. 17, 2025.

(51) Int. Cl.
*E21B 23/01* (2006.01)
*E21B 33/128* (2006.01)
*E21B 33/129* (2006.01)

(52) U.S. Cl.
CPC ..... *E21B 23/01* (2013.01); *E21B 33/1285* (2013.01); *E21B 33/129* (2013.01)

(58) Field of Classification Search
CPC ..... E21B 23/01; E21B 33/1285; E21B 33/129
See application file for complete search history.

(56) References Cited

U.S. PATENT DOCUMENTS 2,122,754 A * 7/1938 Rohrbaugh ..... E21B 33/129 166/239
2,194,331 A * 3/1940 Strom ..... E21B 33/1295 166/239
3,019,842 A 2/1962 Nutter
5,620,050 A 4/1997 Barbee
6,796,380 B2 9/2004 Xu
8,714,270 B2 5/2014 Clemens et al.
9,447,648 B2 9/2016 Mitchell
10,662,735 B2 5/2020 Clemens et al.
10,683,730 B2 6/2020 Johnson et al.
11,162,313 B2 11/2021 Clemens et al.
11,203,908 B2 12/2021 Al Hussin
11,377,924 B2 7/2022 Mitchell
11,555,364 B2 1/2023 Mitchell
11,649,687 B1 * 5/2023 Dawson ..... E21B 17/1078 166/206
11,959,352 B2 4/2024 Mitchell
2012/0298378 A1 11/2012 McCauley et al.
2014/0374119 A1 * 12/2014 Dewars ..... E21B 33/1295 166/120
2019/0017340 A1 1/2019 Clemens et al.
2024/0167353 A1 5/2024 Treadaway

* cited by examiner

*Primary Examiner* — D. Andrews
(74) *Attorney, Agent, or Firm* — Smith IP Services, P.C.

(57) ABSTRACT

An anchor can include an inner mandrel, a slip configured to grip a well surface, and a link arm with pivots at respective opposite ends and the link arm being configured to rotate relative to the slip about a pivot, and the other pivot being configured to displace radially outward relative to the inner mandrel when the anchor is set in the well. A method can include deploying an anchor into a wellbore, and setting the anchor in the wellbore, the setting including displacing a slip radially outward into gripping engagement with a well surface, the displacing including rotating a link arm until a surface of a wedge engages a surface of the link arm and another surface of the link arm engages a surface of the slip.

14 Claims, 10 Drawing Sheets

BRIDGE PLUG WITH BI-DIRECTIONAL HIGH STRENGTH HIGH EXPANSION RETRIEVABLE ANCHOR

CROSS-REFERENCE TO RELATED APPLICATION

The present application claims the benefit of the filing date of US provisional application no., filed on. The entire disclosure of the prior application is incorporated herein by this reference for all purposes.

BACKGROUND

This disclosure relates generally to equipment utilized and operations performed in conjunction with a subterranean well and, in an example described below, more particularly provides a bi-directional high strength and high expansion retrievable anchor.

An anchor can be used for a variety of different purposes in a well. For example, an anchor may be used to secure a packer, a whipstock or another tool in a wellbore or in another tubular. Some anchors are designed to be retrievable, so they can be removed from the well when their function is no longer needed.

Therefore, it will be readily appreciated that improvements are continually needed in the art of designing, constructing and utilizing well tools, such as anchors, bridge plugs and packers. The present disclosure provides such improvements, which may be used with a wide variety of different well operations and configurations.

DETAILED DESCRIPTION

Figure 1:
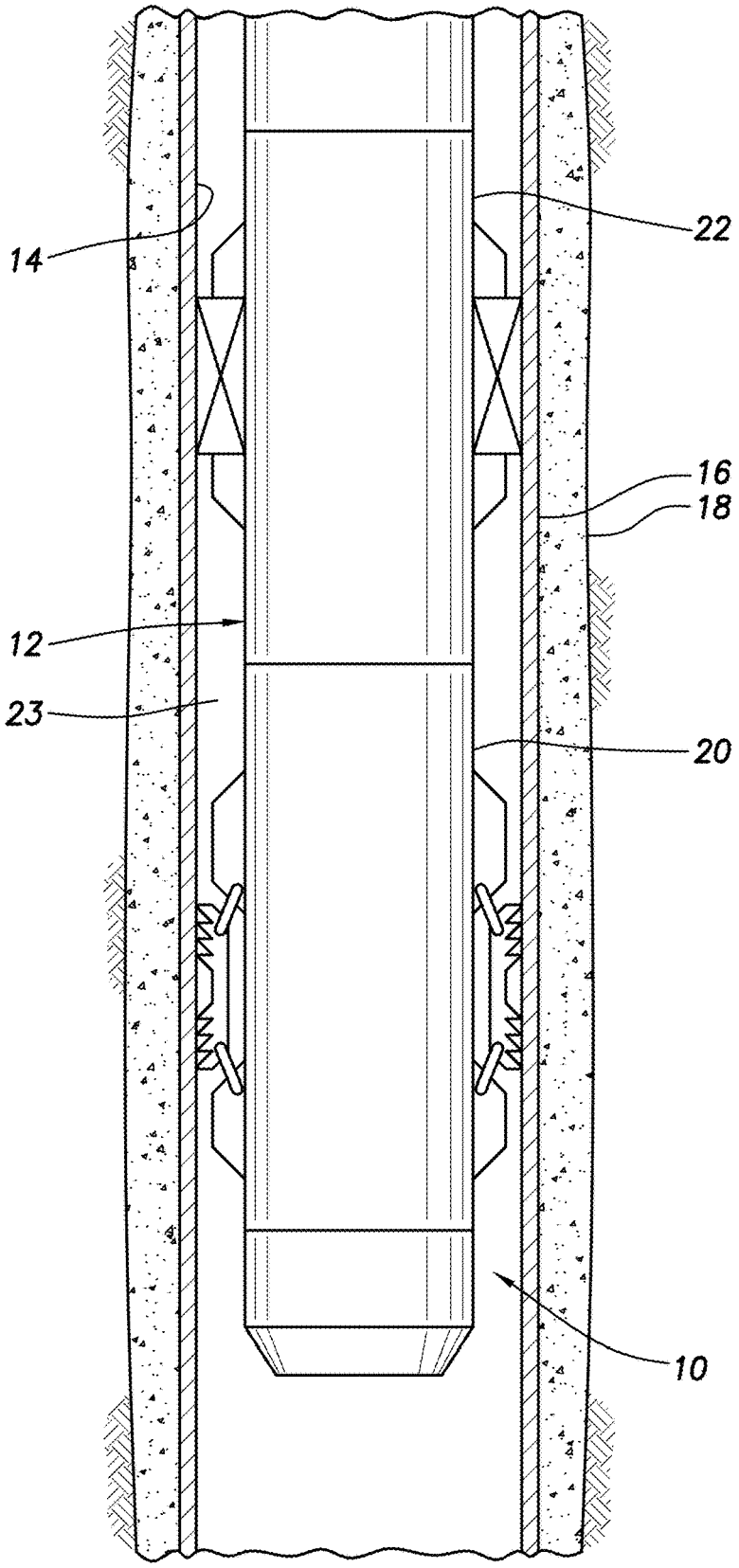
FIG. 1 is a representative partially cross-sectional view of an example of a well system and associated method which can embody principles of this disclosure.

Representatively illustrated in FIG. 1 is a system 10 for use with a subterranean well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a well tool 12 is deployed into a wellbore 14 lined with casing 16 and cement 18. In other examples, the well tool 12 could be deployed into an uncased or open hole section of the wellbore 14.

As depicted in FIG. 1, the well tool 12 includes an anchor 20 and a packer 22. The packer 22 is used in this example to seal off an annulus 23 formed radially between the well tool 12 and the wellbore 14. The anchor 20 is used in this example to secure the packer 22 in the wellbore 14 (e.g., to prevent axial displacement of the packer due to pressure differentials across the packer, or due to loads applied to the packer).

In other examples, the anchor 20 and/or the packer 22 may have other purposes or functions. The anchor 20 could be used to secure other equipment in a well. It is not necessary for both of the anchor 20 and the packer 22 to be used together in any particular well operation. Thus, the scope of this disclosure is not limited to any particular details of the anchor 20 or the packer 22 as used in the FIG. 1 system 10.

In the FIG. 1 example, the well tool 12 is of the type known to those skilled in the art as a bridge plug, which is designed to plug a wellbore. In other examples, the well tool 12 could instead be of the type known to those skilled in the art as a packer assembly (e.g., including both a packer and an anchor, and designed to seal of an annulus about a tubular string, while permitting flow through the tubular string). However, the scope of this disclosure is not limited to use of any particular type of well tool, or to any particular purpose for the well tool's use.

The FIG. 1 well tool 12 is specially designed to be retrievable and to have relatively high expansion capability, so that the well tool can pass through a restriction in the wellbore 14 uphole of a location where it is desired to seal off the wellbore. After passing through the restriction, the anchor 20 and the packer 22 can be set, whereby the anchor grips an inner surface of the wellbore 14 and the packer seals against the inner surface of the wellbore. When use of the well tool 12 is no longer desired, the anchor 20 and packer 22 can be retracted out of engagement with the wellbore 14, and the well tool can be retrieved back through the restriction. In other examples, the well tool 12 may not pass through a restriction during deployment into a wellbore or retrieval from the wellbore.

Figure 2A:
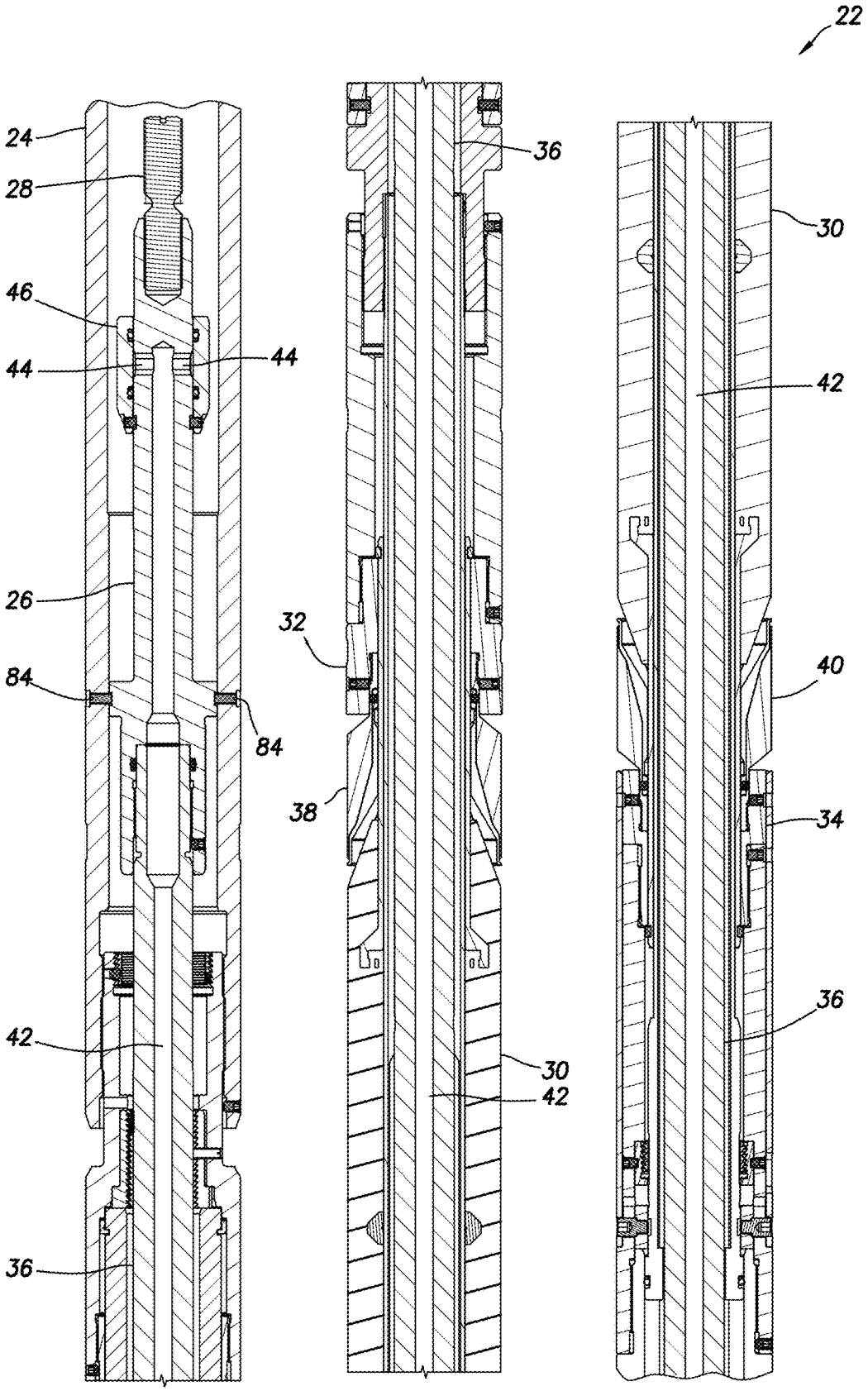
FIGS. 2A & B are representative cross-sectional views of examples of respective packer and anchor sections of a well tool that may be used in the FIG. 1 system and method, the well tool being in a run-in configuration.

Referring additionally now to FIGS. 2A & B, representative cross-sectional views of examples of respective packer 22 and anchor 20 sections of the well tool 12 are depicted. In FIGS. 2A & B, the anchor 20 and packer 22 are in a run-in configuration in which the well tool 12 is deployed into a wellbore. For convenience, the anchor 20 and packer 22 are described below as they may be used in the FIG. 1 system 10 and method, but the anchor and/or packer may be used with other systems and methods in keeping with the scope of this disclosure.

In FIG. 2A it may be seen that the packer 22 includes a setting sleeve 24 and a ported rod 26 at an uphole end of the packer. The setting sleeve 24 and rod 26 in this example are designed to operatively connect the packer 22 to a conventional setting tool (such as, the Baker Model 20™ setting tool, not shown).

The setting sleeve 24 is biased in a downhole direction when the setting tool is actuated. A threaded shear stud 28 connects the rod 26 to a setting mandrel of the setting tool. When a tensile force applied from the setting mandrel to the rod 26 via the shear stud 28 exceeds a predetermined level, the shear stud will shear and the setting tool will be released from the packer 22. The predetermined level is selected so that the anchor 20 and the packer 22 are properly set before the shear stud 28 shears.

The packer 22 further includes an annular seal element 30. In this example, the seal element 30 is designed to extend radially outward into sealing engagement with a well surface (such as, the inner surface of the wellbore 14, or the inner surface of a tubular external to the packer) when the seal element is axially compressed between upper and lower gage rings 32, 34. The seal element 30 and the gage rings 32, 34 are mounted on a generally tubular inner mandrel 36 connected at its upper end to the rod 26.

When the setting tool is actuated, a compressive setting force is applied to the setting sleeve 24 and a tensile setting force is applied to the rod 26 via the stud 28. The compressive setting force is transmitted from the setting sleeve 24 to the upper gage ring 32 and the tensile setting force is transmitted from the rod 26 to the lower gage ring 34 (via the inner mandrel 36 and the anchor 20, as described more fully below). Thus, actuation of the setting tool causes the seal element 30 to be axially compressed between the upper and lower gage rings 32, 34.

In the FIG. 2A example, high expansion backups 38, 40 are designed to extend radially outward when the seal element 30 is axially compressed. The backups 38, 40 block extrusion of the seal element 30 between the packer 22 and the wellbore 14. The backups 38, 40 in this example are also designed so that they can be retracted and retrieved through a restriction in the wellbore 14.

A flow passage 42 extends longitudinally through the inner mandrel 36. The flow passage 42 is in fluid communication with ports 44 formed in the rod 26. An equalization sleeve 46 initially blocks fluid communication through the ports 44 between the flow passage 42 and an interior of the setting sleeve 24.

In this example, the flow passage 42 is in communication with an exterior of the packer 22 below the seal element 30, and the interior of the setting sleeve 24 is in communication with an exterior of the packer above the seal element. Thus, if after the packer 22 is set, the equalization sleeve 46 is displaced axially from its closed position as depicted in FIG. 2A to an open position in which fluid communication through the ports 44 is permitted, pressures existing in the wellbore 14 above and below the seal element 30 will be equalized.

Figure 2B:
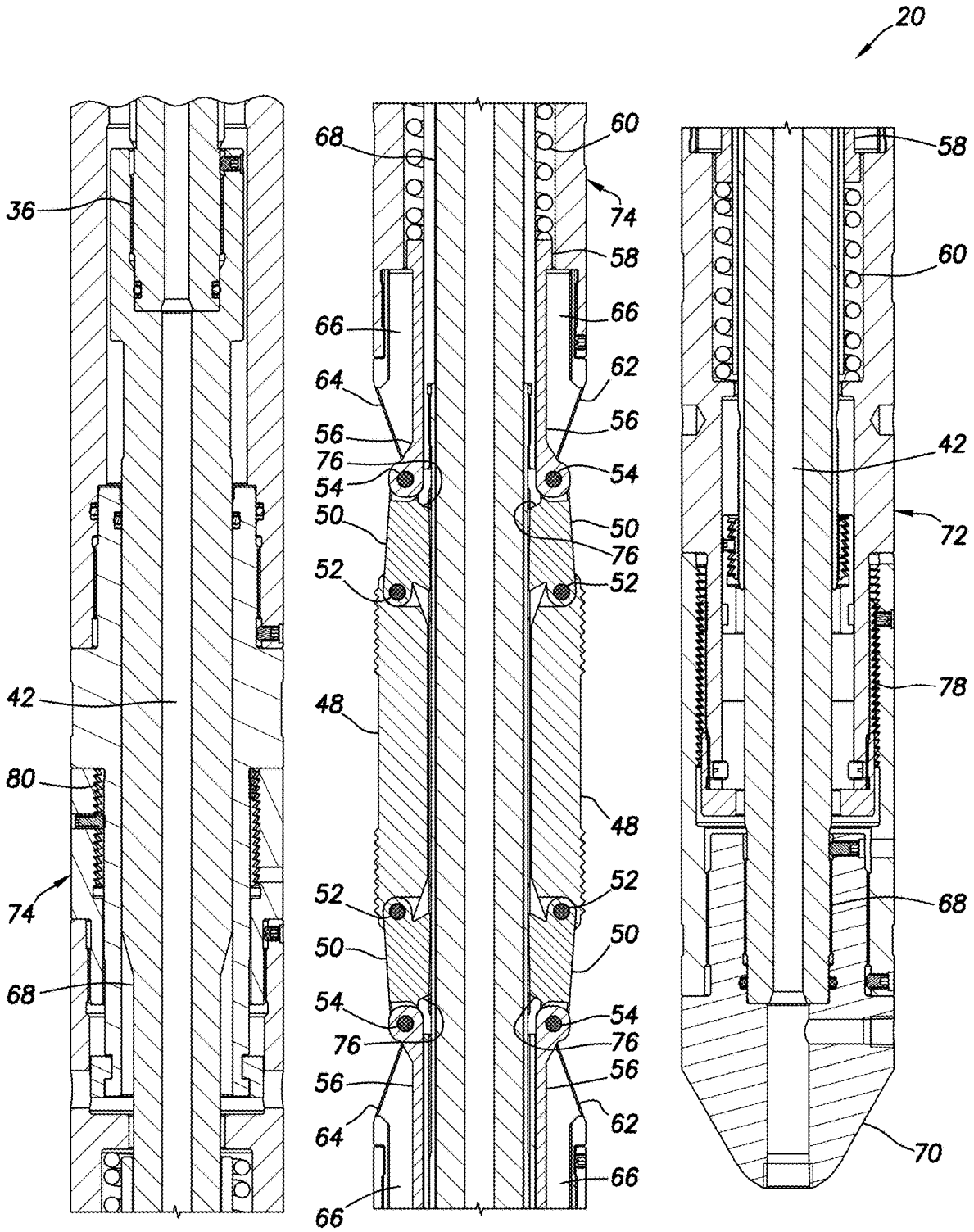

In FIG. 2B it may be seen that the anchor 20 includes slips 48 designed to extend radially outward into gripping engagement with a well surface (such as, the inner surface of the wellbore 14 or a tubular). The slips 48 are pivotably connected to link arms 50 at opposite ends of the slips.

A pivot 52 provides for rotation of each link arm 50 relative to the corresponding slip 48, and another pivot 54 provides for rotation of the link arm relative to a respective flexible collet 56. The collets 56 in this example are formed on upper and lower collet sleeves 58. The collet sleeves 58 are biased toward the slip 48 by springs or other biasing devices 60, but displacement of the collet sleeves is limited by respective upper and lower wedges 62.

The wedges 62 may be in the form of frusta-conical structures with a radially inclined outer deflector surface 64 and slots 66 to receive the respective collets 56. In other examples, the wedges 62 may not have a frusta-conical shape (e.g., if multiple inclined surfaces 64 are formed on each wedge).

The slips 48, link arms 50, collet sleeves 58 and wedges 62 are mounted on a generally tubular inner mandrel 68 that extends axially through the anchor 20. In this example, the inner mandrel 68 is connected at its upper end to the packer inner mandrel 36, and is connected at its lower end to a bull plug 70. The flow passage 42 extends through the inner mandrel 68 and the bull plug 70.

When the setting tool is actuated as described above, the tensile setting force is transmitted via the inner mandrel 36 to the inner mandrel 68 and the bull plug 70, which is connected via an outer housing assembly 72 to the lower wedge 62. The compressive setting force is transmitted via another outer housing assembly 74 to the upper wedge 62. Thus, actuation of the setting tool causes an axial distance between the upper and lower wedges 62 to decrease.

As the distance between the wedges 62 decreases, the link arms 50 and slips 48 will be displaced radially outward by the inclined surfaces 64. In addition, engagement between the wedges 62 and surfaces 76 formed on the link arms 50 will act to rotate the link arms outward.

A ratchet 78 in the outer housing assembly 72 allows the lower wedge 62 to displace uphole (toward the slip 48) relative to the bull plug 70 and inner mandrel 68, but prevents displacement of the lower wedge in an opposite axial direction. Another ratchet 80 in the outer housing assembly 74 allows the upper wedge 62 to displace downhole (toward the slip 48), but prevents displacement of the upper wedge in an opposite axial direction. In this example, the ratchets 78, 80 each include a device known to those skilled in the art as a body lock ring.

Figure 3A:
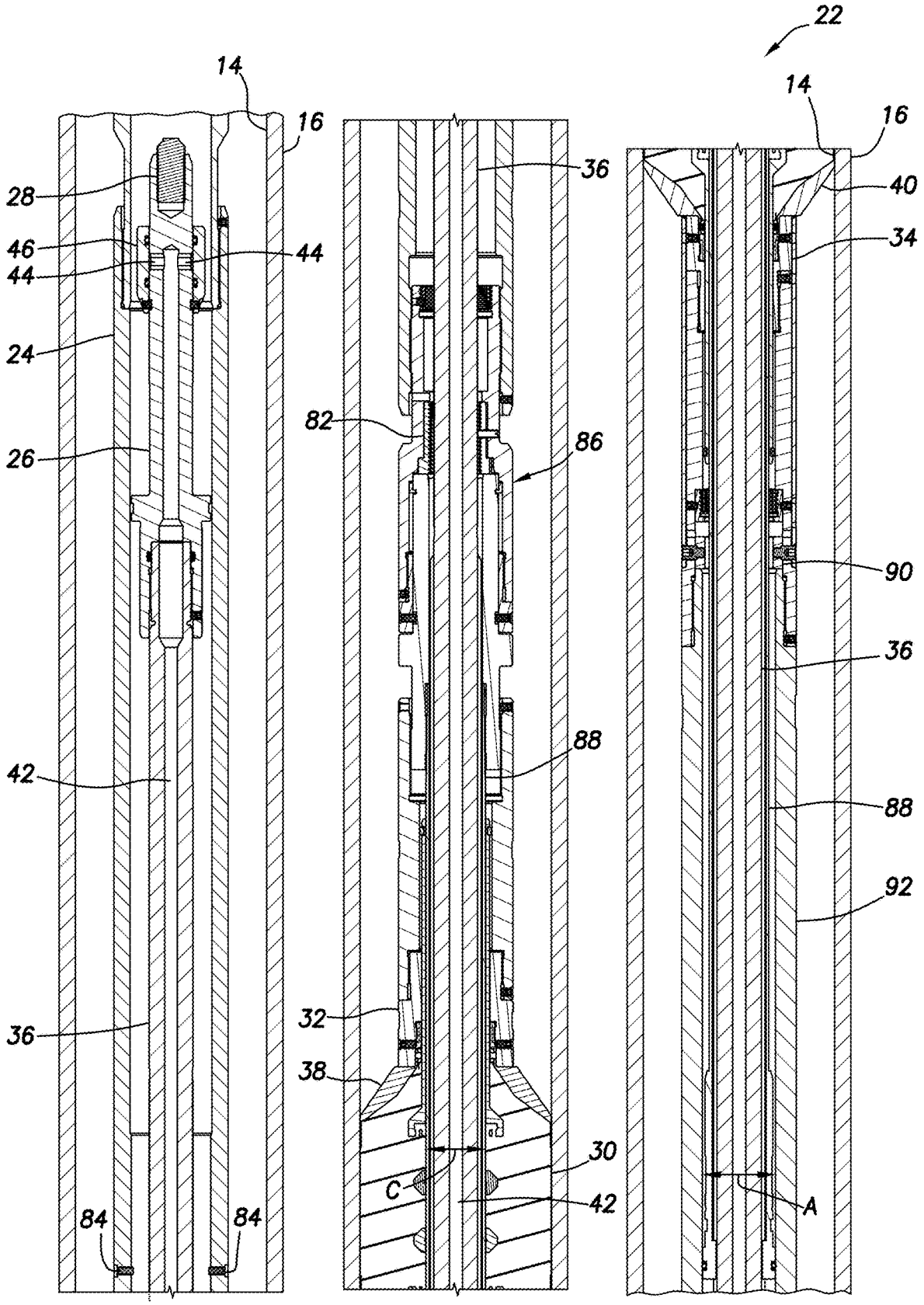
FIGS. 3A & B are representative cross-sectional views of examples of the respective packer and anchor sections in a set configuration.

Referring additionally now to FIGS. 3A & B, representative cross-sectional views of examples of the respective packer 22 and anchor 20 are depicted in a set configuration. Note that the shear stud 28 is sheared as depicted in FIG. 3A, indicating that the compressive setting force has been applied to the setting sleeve 24, and the tensile setting force has been applied to the rod 26 and inner mandrel 36, so that the anchor 20 and the packer 22 are set in the wellbore 14. The slips 48 are extended radially outward into gripping engagement with the inner surface of the wellbore 14 and the seal element 30 is extended radially outward into sealing engagement with the inner surface of the wellbore.

In FIG. 3A, it may be seen that an axial distance between the gage rings 32, 34 is decreased, thereby axially compressing the seal element 30 between the gage rings. A ratchet 82 prevents axial displacement of the upper gage ring 32 away from the seal element 30 (uphole relative to the inner mandrel 36), but permits axial displacement of the upper gage ring toward the seal element.

The compressive setting force is transmitted through the setting sleeve 24 to shear screws 84 (see FIG. 2A) that releasably secure the rod 26 in the setting sleeve. The shear screws 84 will shear and the compressive setting force will then displace the setting sleeve 24 and an outer housing assembly 86 in the downhole direction. The ratchet 82 is contained in the outer housing assembly 86.

The compressive setting force is transmitted from the outer housing assembly 86 to a tubular element mandrel 88 that overlies the inner mandrel 36 and extends through the seal element 30. The compressive setting force transmitted to the element mandrel 88 effectively bypasses the element 30 and is transmitted via a slip ring 90 and shear screws (not visible in FIG. 3A) to an outer housing 92. The outer housing 92 is connected to the outer housing assembly 74 of the anchor 20.

Figure 3B:
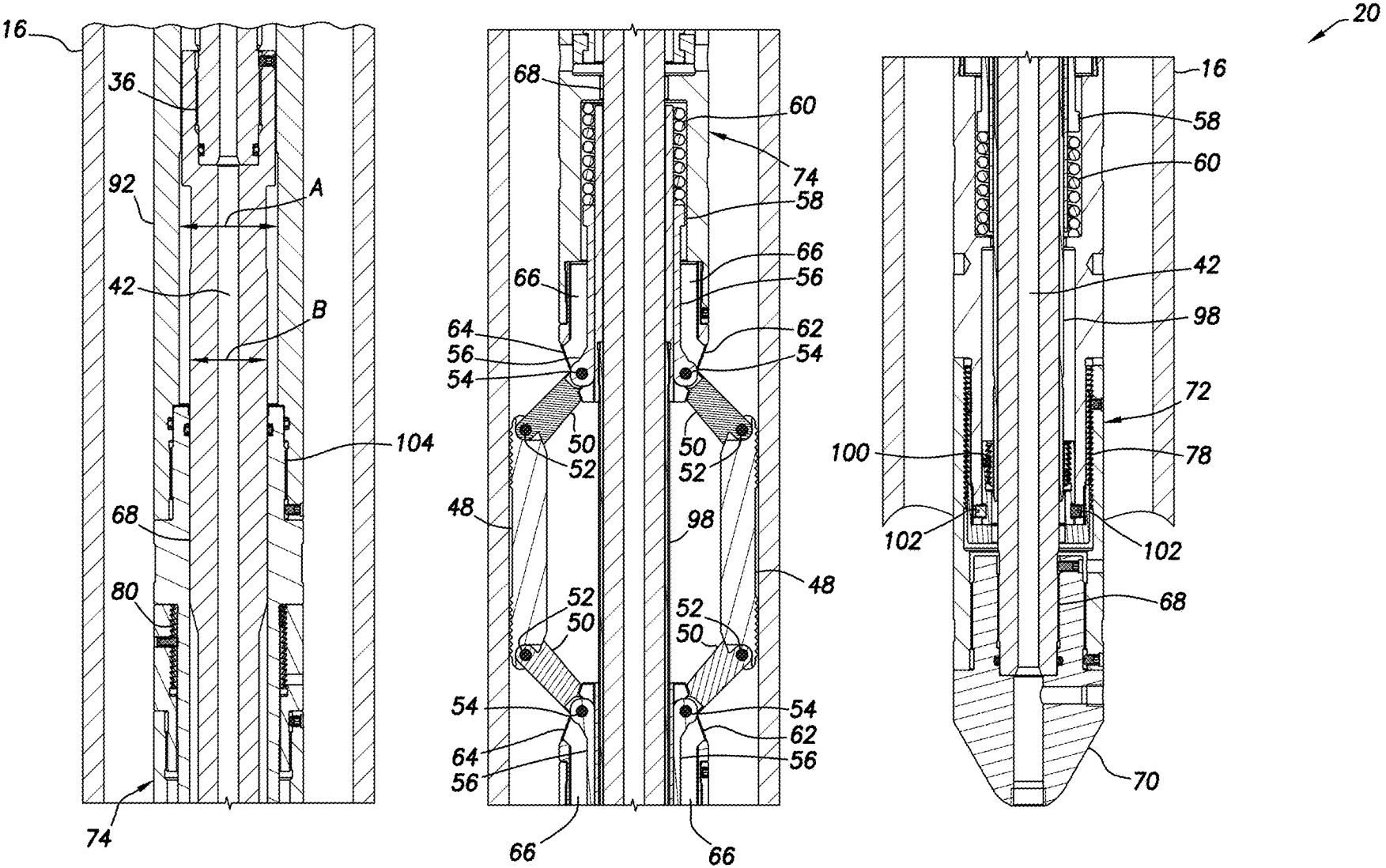

As depicted in FIG. 3B, when the compressive setting force is transmitted via the outer housing 92 to the outer housing assembly 74, the axial distance between the upper and lower pivots 54 and wedges 62 decreases and the link arms 50 rotate outward, with the pivots 52 being displaced radially outward with the slips 48. The link arms 50 rotate about the pivots 54 relative to the collets 56, and the link arms rotate about the pivots 52 relative to the slips 48.

Figure 4:
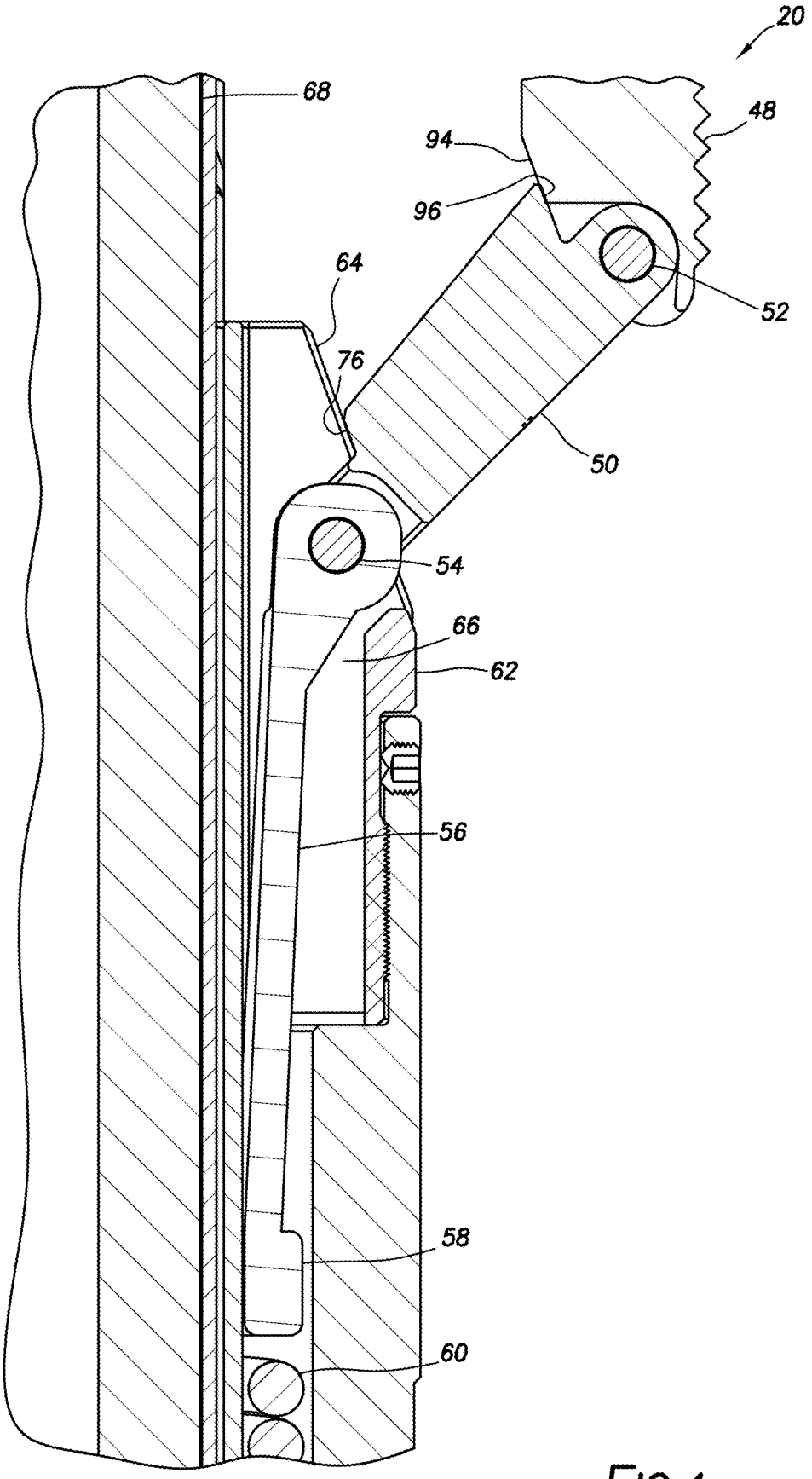
FIG. 4 is a representative cross-sectional view of examples of a slip, link arm and wedge of the anchor in the set configuration.

Referring additionally now to FIG. 4, a representative cross-sectional view of one set of the slip 48, link arm 50 and wedge 62 of the anchor 20 in the set configuration is depicted. The link arm 50 has rotated outward, until the surface 76 has engaged the surface 64 on the wedge 62, thereby outwardly supporting the link arm. This eliminates any need for the pivot 54 to outwardly support the link arm 50, thereby providing a strengthened slip support system.

A surface 94 formed on the slip 48 engages a surface 96 formed on the link arm 50 as the link arm rotates outward. This engagement between the surfaces 94, 96 prevents further rotation of the link arm 50 and effectively locks the link arm in this position relative to the slip 48. In addition, the engagement between the surfaces 94, 96 eliminates any need for the pivot 52 to outwardly support the slip 48, thereby enhancing the strengthened slip support system.

The axial distance between the wedges 62 can continue to decrease after the surfaces 64, 76 have contacted each other, and after the surfaces 94, 96 have contacted each other, so that the slip 48 and link arms 50 are an axially incompressible assembly. This assembly of slip 48 and link arms 50 can be deflected further radially outward by the inclined surfaces 64 of the wedges 62. Specifically, the inclined surface 64 on a wedge 62 can slide along the surface 76 on the link arm 50 to thereby deflect the link arm and slip 48 radially outward.

As depicted in FIG. 4, the wedge 62 has displaced axially upward relative to the link arm 50, so that the link arm, the slip 48 and the pivots 52, 54 are deflected radially outward. The slot 66 in the wedge 62 permits the collet 56 and pivot 54 to deflect radially outward through the wedge 62. The biasing device 60 is axially compressed when the wedge 62 displaces (as viewed in FIG. 4) relative to the collet sleeve 58.

Referring again to FIG. 3B, the upper wedge 62 is connected to a wedge mandrel 98 that overlies the inner mandrel 68 and extends into the outer housing assembly 72. The lower wedge 62 is connected to the outer housing assembly 72, which contains the ratchet 78 and another ratchet 100 positioned to engage a lower end of the mandrel 98. The ratchet 100, when engaged with the mandrel 98, permits downhole displacement of the mandrel, but prevents uphole displacement of the mandrel. However, when it is desired to release the anchor 20, shear screws 102 can be sheared to release the ratchet 100 and permit uphole displacement of the mandrel 98, as described more fully below.

As depicted in FIG. 3B, the mandrel 98 has been displaced downhole with the upper wedge 62, so that the lower end of the mandrel 98 is received in and gripped by the ratchet 100. Thus, in the set configuration of the anchor 20, the compressive setting force remains applied to the slips 48, link arms 50 and wedges 62, until the shear screws 102 are sheared to release the anchor.

After the anchor 20 is set, and at a predetermined setting force level, the shear screws securing the slip ring 90 to the outer housing 92 (see FIG. 3A) will shear. The element mandrel 88 can then be displaced downhole by the compressive setting force, thereby axially compressing the seal element 30 between the gage rings 32, 34. Thus, the anchor 30 is set prior to the packer 22 being set in this example.

With the anchor 20 and packer 22 set in the wellbore 14, the seal element 30 can seal against a pressure differential applied across the packer in a downhole direction (i.e., pressure uphole of the seal element being greater than pressure downhole of the seal element) or in an uphole direction (i.e., pressure downhole of the seal element being greater than pressure uphole of the seal element). In the FIGS. 3A & B example, the axial compression of the seal element 30 can be enhanced when the pressure differential is applied either in the uphole direction, or in the downhole direction.

An annular piston 104 of the outer housing assembly 74 (see FIG. 3B) is slidingly and sealingly engaged with the inner mandrel 68. The ratchet 80 permits uphole displacement of the piston 104 and outer housing 92 relative to the upper wedge 62, but prevents downhole displacement of the piston and outer housing relative to the upper wedge. Thus, when the anchor 20 is set, the outer housing 92 and lower gage ring 34 (see FIG. 3A) can only displace in an uphole direction to further compress the seal element 30.

A difference in area between an inner diameter of the outer housing 92 (Area A) and an outer diameter of the inner mandrel 68 (Area B) is a piston area (A–B) to which a pressure differential in the uphole direction can be applied. The seal element 30 is seated on the element mandrel 88 with an external seal against the inner diameter (Area A) of the outer housing 92.

When the pressure differential is applied in the downhole direction, the inner mandrel 36 is biased in the downhole direction by the pressure differential. The area of the outer diameter (Area B) of the inner mandrel 68 is a piston area to which the pressure differential in the downhole direction can be applied. However, an opposing piston area comprises a difference in area between Area A and an area (Area C) in which the seal element 30 is seated on the element mandrel 88. Therefore, the resultant net piston area is (B–(A–C)). The ratchet 78 permits the inner mandrels 36, 68 to displace in the downhole direction due to the pressure differential in the downhole direction, but prevents displacement of the inner mandrels in the uphole direction, thereby enhancing compression of the seal element 30.

When greater pressure is applied uphole of the seal element 30, the inner mandrel 36 will be displaced toward the seal element. The axial force applied to the seal element 30 is the pressure differential in the downhole direction multiplied by the piston area (B–(A–C)). This additional compressive force helps to maintain a sealing capability of the seal element 30. The ratchet 78 is used to trap the compressive force in the seal element 30.

Alternatively, when greater pressure is applied downhole of the seal element 30, the outer housing 92 and piston 104 will be displaced axially toward the seal element to exert a compressive axial force on the seal element. The axial force applied to the seal element 30 is the pressure differential multiplied by the piston area (A–B). This additional compressive force helps to maintain the sealing capability of the seal element 30. The ratchet 80 is used to trap the compressive force in the seal element 30.

Figure 5A:
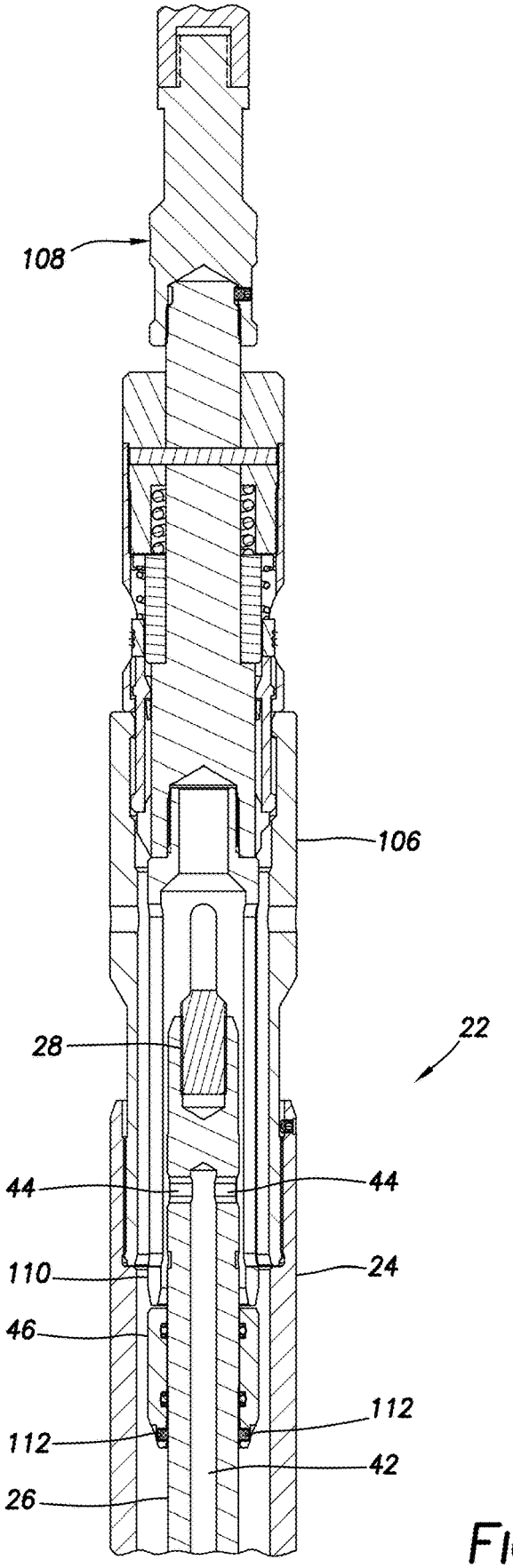
FIGS. 5A & B are representative cross-sectional views of examples of the respective packer and anchor sections in a pressure equalized configuration.
Figure 5B:
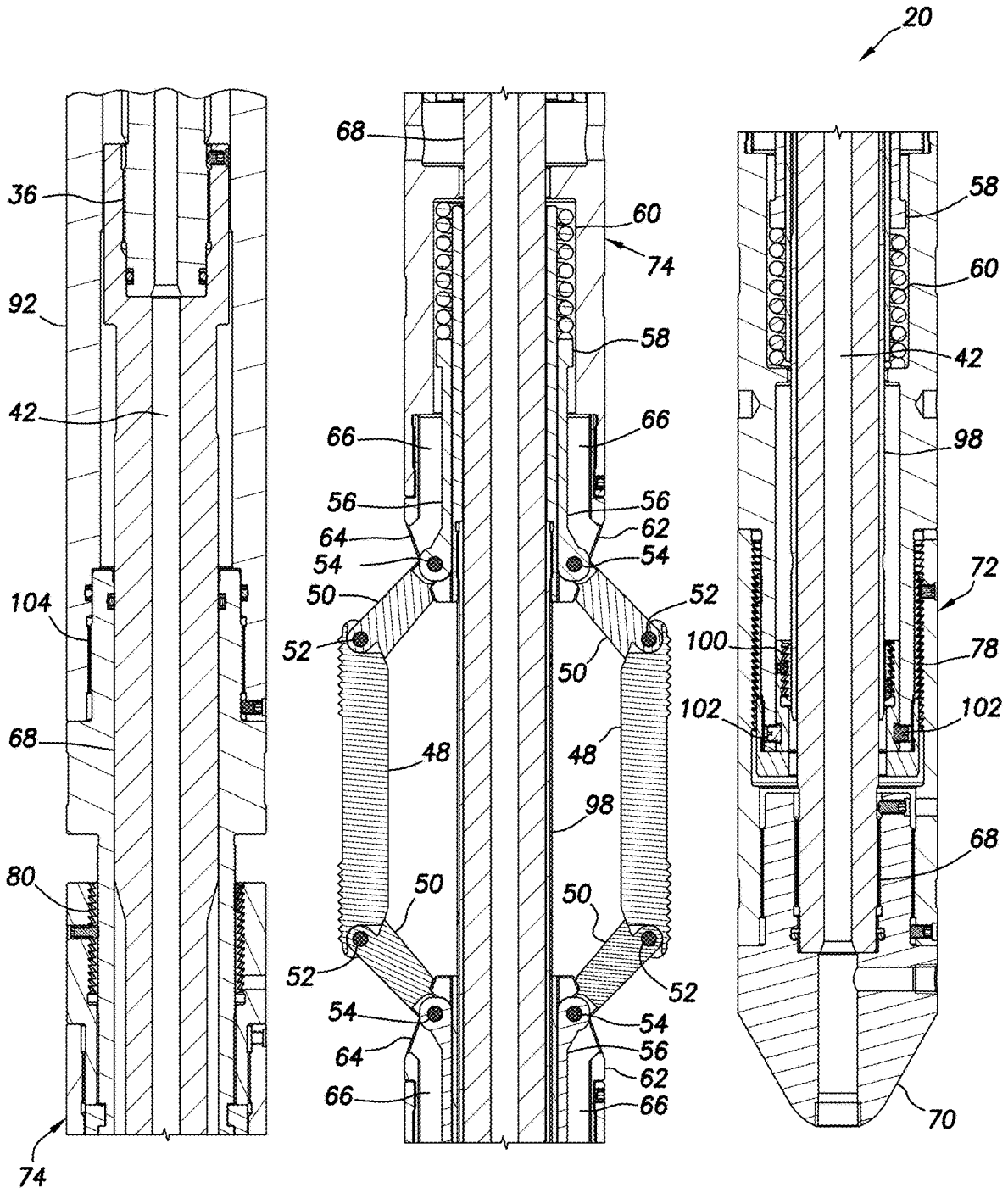

Referring additionally now to FIGS. 5A & B, representative cross-sectional views of examples of the respective packer 22 and anchor 20 in a pressure equalized configuration are depicted. Pressure can be equalized across the packer 22 in preparation for unsetting and retrieving the well tool 12, for example, so that the seal element 30 is not disengaged from the wellbore 14 while there is a pressure differential across the seal element.

Only an upper portion of the packer 22 is depicted in FIG. 5A. In this view, it may be seen that a fishing neck 106 is connected at an upper end of the setting sleeve 24. When it is desired to equalize pressure across the packer 22, a fishing or pulling tool 108 is deployed and latched into the fishing neck 106.

A slotted prong 110 extends downward from the pulling tool 108 and engages the equalization sleeve 46. Sufficient weight applied via the pulling tool 108 will shear shear screws 112 that releasably secured the equalization sleeve 46 on the rod 26. The prong 110 will displace the equalization sleeve 46 to an open position in which fluid communication through the ports 44 is permitted.

With the ports 44 opened, the pressures uphole and downhole of the seal element 30 equalize. The anchor 20 and packer 22 can now be released and retrieved by applying a tensile uphole directed force to the fishing neck 106 via the pulling tool 108.

Figure 6A:
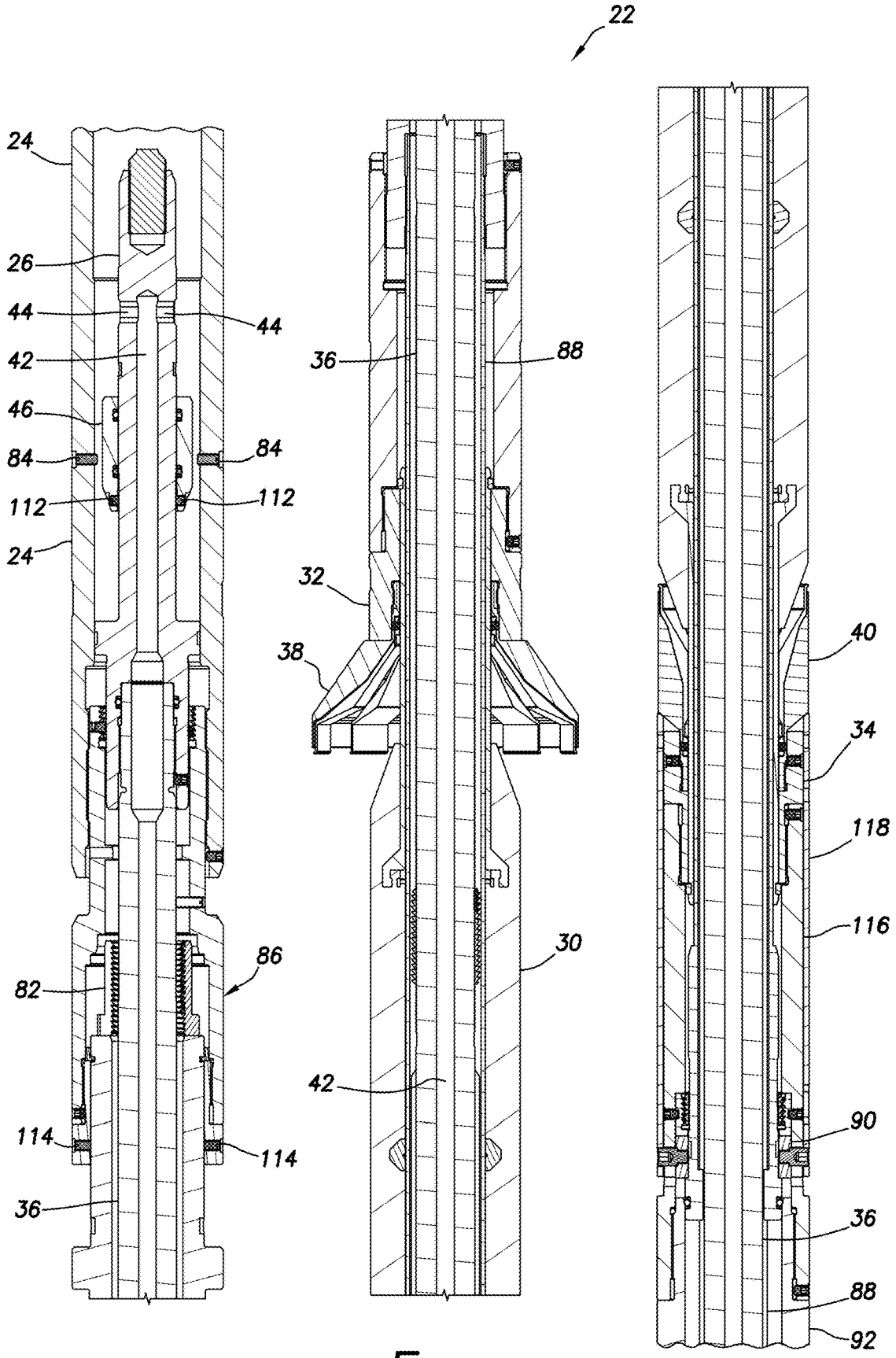
FIGS. 6A & B are representative cross-sectional views of examples of the respective packer and anchor sections in a released configuration.
Figure 6B:
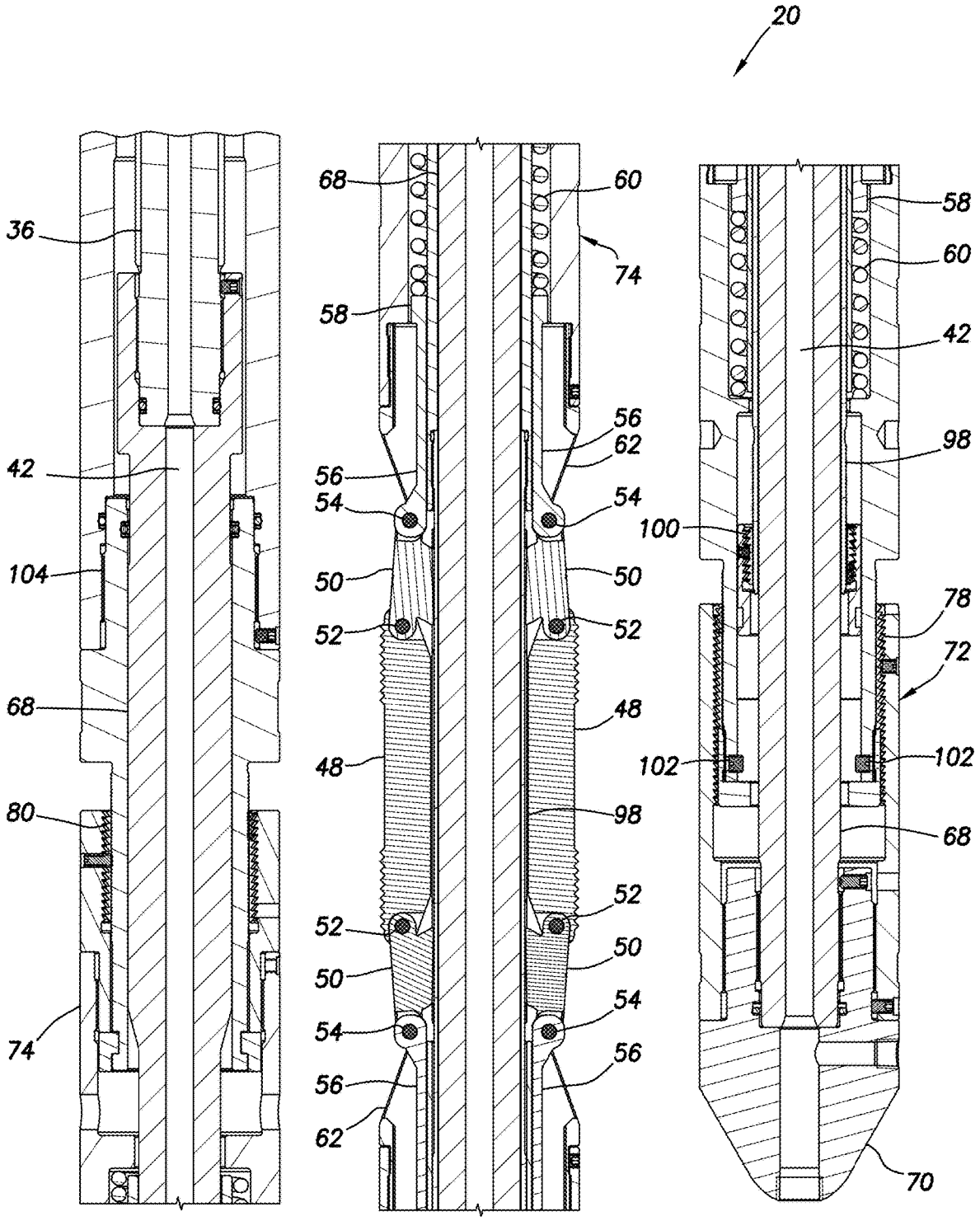

Referring additionally now to FIGS. 6A & B, representative cross-sectional views of examples of the respective packer 22 and anchor 20 in a released configuration are depicted. In this configuration, the seal element 30 of the packer 22 and the slips 48 of the anchor 20 are retracted radially inward and out of engagement with the inner surface of the wellbore 14.

The tensile force applied from the pulling tool 108 to the fishing neck 106 causes shear screws 114 to shear, thereby allowing an upper portion of the outer housing assembly 86 to displace upward. When the upper portion of the outer housing assembly 86 displaces upward, the ratchet 82 is released (in this example, a body lock ring of the ratchet is no longer outwardly supported).

With the ratchet 82 released, the tensile force is applied to the seal element 30, thereby radially inwardly retracting the seal element. The element mandrel 88 displaces upward with the upper gage ring 32 when the seal element 30 is retracted, thereby displacing a housing 116 and outer sleeve 118 upward. The sleeve 118 slides over the lower gage ring 34 and causes the lower backup 40 to radially inwardly retract. This application of tensile force to the packer 22, and retraction of the seal element 30 and lower backup 40 is facilitated by the continued set configuration of the anchor 20.

To unset the anchor 20, the tensile force is applied via the outer housing 92 and the wedge mandrel 98 to shear the shear screws 102. This allows the axial distance between the wedges 62 to increase. The link arms 50 rotate radially inward, and the slips 48 displace radially inward and out of engagement with the inner surface of the wellbore 14.

At this point, only the upper backup 38 of the packer 22 remains radially extended. The upper backup 38 will be deflected inward as needed to pass through any restrictions while the packer 22 is retrieved from the wellbore 14.

It may now be fully appreciated that the above disclosure provides significant benefits to the art of designing, constructing and utilizing anchors and packers for subterranean wells. In an example described above, the anchor 20 is capable of relatively high expansion, so it can be utilized downhole of restrictions in the wellbore 14, but the anchor is also capable of exerting a relatively high radial force to the slips 48 to resist pressure differentials across the seal element 30 of the packer 22.

The above disclosure provides to the art an anchor 20 for use with a subterranean well. In one example, the anchor 20 can comprise: an inner mandrel 68; a slip 48 configured to grip a well surface (such as, the inner surface of the wellbore 14 or a tubular); and a link arm 50 with first and second pivots 52, 54 at respective opposite ends of the link arm 50, the link arm 50 being configured to rotate relative to the slip 48 about the first pivot 52, and the second pivot 54 being configured to displace radially outward relative to the inner mandrel 68 when the anchor 20 is set in the well.

The second pivot 54 may connect the link arm 50 to a flexible collet 56 configured to permit radial displacement of the second pivot 54. The anchor 20 may include a first wedge 62 configured to deflect the link arm 50 radially outward. The collet 56 may be configured to flex radially through a slot 66 formed in the first wedge 62.

A first surface 64 of the first wedge 62 may be configured to engage a second surface 76 of the link arm 50 when the first wedge 62 deflects the link arm 50 radially outward. A third surface 96 of the link arm 50 may be configured to engage a fourth surface 94 of the slip 48 when the first wedge 62 deflects the link arm 50 radially outward. The third surface 96 of the link arm 50 may be further configured to limit rotation of the link arm 50 relative to the slip 48.

The anchor 20 may include a first ratchet 78 that permits displacement of the first wedge 62 in a first axial direction relative to the inner mandrel 68 but prevents displacement of the first wedge 62 in an opposite second axial direction relative to the inner mandrel 68, and a second ratchet 80 that permits displacement of a second wedge 62 in the second axial direction relative to the inner mandrel 68 but prevents displacement of the second wedge 62 in the first axial direction relative to the inner mandrel 68.

The anchor 20 may include a first net piston area (B−(A−C)) configured to bias the inner mandrel 68 in the first axial direction in response to a pressure differential in the first axial direction in the well, and a second net piston area (A-B) configured to bias the inner mandrel 68 in the second axial direction in response to a pressure differential in the second axial direction in the well.

Also provided to the art by the above disclosure is a method for use with a subterranean well. In one example, the method can include: deploying an anchor 20 into a wellbore 14; and setting the anchor 20 in the wellbore 14. The setting step can include displacing a slip 48 radially outward into gripping engagement with a well surface (such as, the inner surface of the wellbore 14 or a tubular). The displacing step can include rotating a link arm 50 until a first surface 64 of a first wedge 62 engages a second surface 76 of the link arm 50 and a third surface 96 of the link arm 50 engages a fourth surface 94 of the slip 48.

The engagement between the first and second surfaces 64, 76 may prevent further rotation of the link arm 50 relative to the first wedge 62, and the engagement between the third and fourth surfaces 96, 94 may prevent further rotation of the link arm 50 relative to the slip 48.

The first surface 64 may be inclined so that relative axial displacement between the first and second surfaces 64, 76 deflects the link arm 50 radially outward.

The link arm 50 may be pivotably connected to a flexible collet 56. The displacing step may include radially outwardly displacing a pivot 54 between the link arm 50 and the collet 56. The pivot displacing may include flexing the collet 56 in a slot 66 formed in the first wedge 62.

A first ratchet 78 may permit displacement of the first wedge 62 in a first axial direction relative to an inner mandrel 68 of the anchor 20 but prevent displacement of the first wedge 62 in a second axial direction relative to the inner mandrel 68, the second axial direction being opposite to the first axial direction. A second ratchet 80 may permit displacement of a second wedge 62 in the second axial direction relative to the inner mandrel 68 but prevent displacement of the second wedge 62 in the first axial direction relative to the inner mandrel 68.

The method may include connecting a packer 22 to the anchor 20, the packer 22 including an annular seal element 30. A first net piston area (B−(A−C)) may bias the seal element 30 in the first axial direction in response to a pressure differential in the first axial direction across the seal element 30, and a second net piston area (A–B) may bias the seal element 30 in the second axial direction in response to a pressure differential in the second axial direction across the seal element 30.

A well tool 12 for use in a subterranean well is provided to the art by the above disclosure. In one example, the well tool 12 can comprise: a packer 20 with an annular seal element 30 configured to seal against a well surface; and an anchor 20 comprising a slip 48 configured to grip the well surface, an inner mandrel 68, a first ratchet 79 configured to permit displacement of a first wedge 62 in a first axial direction relative to the inner mandrel 68 but prevent displacement of the first wedge 62 in a second axial direction relative to the inner mandrel 68, the second axial direction being opposite to the first axial direction, a second ratchet 80 configured to permit displacement of a second wedge 62 in the second axial direction relative to the inner mandrel 68 but prevent displacement of the second wedge 62 in the first axial direction relative to the inner mandrel 68, a first net piston area (B–(A–C)) configured to bias a first gage ring 34 in the first axial direction in response to a pressure differential in the first axial direction across the packer 22, and a second net piston area (A–B) configured to bias a second gage ring 32 in the second axial direction in response to a pressure differential in the second axial direction across the packer 22.

The well tool 12 may include a link arm 50 with first and second pivots 52, 54 at respective opposite ends of the link arm 50, the link arm 50 being configured to rotate relative to the slip 48 about the first pivot 52, and the second pivot 54 being configured to displace radially outward relative to the inner mandrel 68 when the anchor 20 is set in the well. The second pivot 54 may connect the link arm 50 to a flexible collet 56 configured to permit radial displacement of the second pivot 54.

The first wedge 62 may be configured to deflect the link arm 50 radially outward. A first inclined surface 64 of the first wedge 62 may be configured to engage a second inclined surface 76 of the link arm 50 when the first wedge 62 deflects the link arm 50 radially outward, and a third inclined surface 96 of the link arm 50 may be configured to engage a fourth inclined surface 94 of the slip 48 when the first wedge 62 deflects the link arm 50 radially outward.

A method for use with a subterranean well described herein can comprise: constructing a well tool 12 comprising a packer 22 and an anchor 20, the packer 22 comprising an annular seal element 30 configured to seal against a well surface; and an anchor 20 comprising a slip 48 configured to grip the well surface, an inner mandrel 68, a first ratchet 79 configured to permit displacement of a first wedge 62 in a first axial direction relative to the inner mandrel 68 but prevent displacement of the first wedge 62 in a second axial direction relative to the inner mandrel 68, the second axial direction being opposite to the first axial direction, a second ratchet 80 configured to permit displacement of a second wedge 62 in the second axial direction relative to the inner mandrel 68 but prevent displacement of the second wedge 62 in the first axial direction relative to the inner mandrel 68, a first net piston area (B–(A–C)) configured to bias a first gage ring 34 in the first axial direction in response to a pressure differential in the first axial direction across the packer 22, and a second net piston area (A–B) configured to bias a second gage ring 32 in the second axial direction in response to a pressure differential in the second axial direction across the packer 22; deploying the well tool 12 into the well; setting the anchor 20; setting the packer 22; unsetting the packer 22; and unsetting the anchor 20.

The setting of the anchor 20 may be performed prior to the setting of the packer 22.

A compressive force due to the pressure differential in the second axial direction may be transmitted via the anchor 20 to the seal element 30 after the setting of the anchor 20.

The packer 22 may include an equalization sleeve 46. The method may include displacing the equalization sleeve 46 to an open position prior to the unsetting of the packer 22.

The unsetting of the packer 22 may include applying a tensile force to the seal element 30. The unsetting of the packer 22 may be performed prior to the unsetting of the anchor 20.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," "upward," "downward," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. An anchor for use with a subterranean well, the anchor comprising:

an inner mandrel;

a slip configured to grip a well surface; and a link arm with first and second pivots at respective opposite ends of the link arm, the link arm being configured to rotate relative to the slip about the first pivot, and the second pivot being configured to displace radially outward relative to the inner mandrel when the anchor is set in the well, in which the second pivot connects the link arm to a flexible collet configured to permit radial displacement of the second pivot.

2. The anchor of claim 1, further comprising a first wedge configured to deflect the link arm radially outward.

3. The anchor of claim 2, in which a first surface of the first wedge is configured to engage a second surface of the link arm when the first wedge deflects the link arm radially outward.

4. The anchor of claim 3, in which a third surface of the link arm is configured to engage a fourth surface of the slip when the first wedge deflects the link arm radially outward.

5. The anchor of claim 4, in which the third surface of the link arm is further configured to limit rotation of the link arm relative to the slip.

6. The anchor of claim 2, in which the collet is configured to flex radially through a slot formed in the first wedge.

7. The anchor of claim 2, further comprising:

a first ratchet that permits displacement of the first wedge in a first axial direction relative to the inner mandrel but prevents displacement of the first wedge in a second axial direction relative to the inner mandrel, the second axial direction being opposite to the first axial direction; and a second ratchet that permits displacement of a second wedge in the second axial direction relative to the inner mandrel but prevents displacement of the second wedge in the first axial direction relative to the inner mandrel.

8. A method for use with a subterranean well, the method comprising:

deploying an anchor into a wellbore; and setting the anchor in the wellbore, the setting comprising displacing a slip radially outward into gripping engagement with a well surface, the displacing comprising rotating a link arm until a first surface of a first wedge engages a second surface of the link arm and a third surface of the link arm engages a fourth surface of the slip.

9. The method of claim 8, in which the engagement between the first and second surfaces limits rotation of the link arm relative to the first wedge, and the engagement between the third and fourth surfaces limits rotation of the link arm relative to the slip.

10. The method of claim 8, in which the first surface is inclined so that relative axial displacement between the first and second surfaces deflects the link arm radially outward.

11. The method of claim 8, in which the link arm is pivotably connected to a flexible collet, and the displacing further comprises radially outwardly displacing a pivot between the link arm and the collet.

12. The method of claim 11, in which the pivot displacing comprises flexing the collet in a slot formed in the first wedge.

13. The method of claim 8, further comprising:

configuring a first ratchet to permit displacement of the first wedge in a first axial direction relative to an inner mandrel of the anchor but prevent displacement of the first wedge in a second axial direction relative to the inner mandrel, the second axial direction being opposite to the first axial direction; and configuring a second ratchet to permit displacement of the second wedge in the second axial direction relative to the inner mandrel but prevent displacement of the second wedge in the first axial direction relative to the inner mandrel.

14. The method of claim 13, further comprising:

connecting a packer to the anchor, the packer including an annular seal element;

a first net piston area biasing the seal element in the first axial direction in response to a pressure differential in the first axial direction across the seal element; and configuring a second net piston area to bias the seal element in the second axial direction in response to a pressure differential in the second axial direction across the seal element.

* * * * *